US009061783B2

(12) United States Patent
Koenigkramer et al.

(10) Patent No.: US 9,061,783 B2
(45) Date of Patent: Jun. 23, 2015

(54) FIN SEAL REGISTRATION IN MANUFACTURE OF RECLOSABLE PACKAGES

(75) Inventors: Rusty Koenigkramer, Nanuet, NY (US); Murray Edward Bruce Leighton, Sugarhill (GA)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1139 days.

(21) Appl. No.: 13/034,768

(22) Filed: Feb. 25, 2011

(65) Prior Publication Data

US 2012/0047849 A1 Mar. 1, 2012

Related U.S. Application Data

(60) Provisional application No. 61/329,361, filed on Apr. 29, 2010.

(51) Int. Cl.

| | |
|---|---|
| ***B65B 61/18*** | (2006.01) |
| ***B65B 51/04*** | (2006.01) |
| ***B65B 9/20*** | (2012.01) |
| ***B65B 9/207*** | (2012.01) |
| ***B65B 41/16*** | (2006.01) |
| ***B65B 41/18*** | (2006.01) |
| ***B65B 51/30*** | (2006.01) |
| ***B65B 57/04*** | (2006.01) |

(52) U.S. Cl.

CPC ..... *B65B 61/188* (2013.01); *B65B 9/2028* (2013.01); *B65B 9/207* (2013.01); *B65B 41/16* (2013.01); *B65B 41/18* (2013.01); *B65B 51/306* (2013.01); *B65B 57/04* (2013.01); *B65B 2220/08* (2013.01)

(58) Field of Classification Search

CPC ..... B31B 1/74; B31B 1/90; B31B 1/11; B31B 19/90

USPC ..... 53/450, 412, 452, 471, 562, 264

See application file for complete search history.

(56) References Cited

U.S. PATENT DOCUMENTS

| | | | | |
|---|---|---|---|---|
| 4,909,017 | A * | 3/1990 | McMahon et al. | 53/410 |
| 5,461,845 | A * | 10/1995 | Yeager | 53/451 |
| 6,003,582 | A * | 12/1999 | Blohowiak et al. | 156/567 |
| 6,185,907 | B1 * | 2/2001 | Malin et al. | 53/412 |
| 6,195,967 | B1 * | 3/2001 | Todd et al. | 53/562 |
| 6,363,692 | B2 * | 4/2002 | Thieman | 53/412 |
| 6,477,820 | B1 * | 11/2002 | Dutra et al. | 53/412 |
| 6,516,850 | B1 * | 2/2003 | Blohowiak et al. | 156/352 |
| 6,691,491 | B2 * | 2/2004 | Terminella et al. | 53/133.4 |
| 6,740,019 | B2 * | 5/2004 | Bois | 493/156 |
| 6,863,754 | B2 * | 3/2005 | Wright et al. | 156/64 |
| 6,886,310 | B1 * | 5/2005 | Bois | 53/412 |
| 6,925,779 | B2 * | 8/2005 | Thieman | 53/412 |
| 6,941,726 | B2 * | 9/2005 | Ausnit | 53/412 |

(Continued)

FOREIGN PATENT DOCUMENTS

| | | |
|---|---|---|
| EP | 1 203 718 | 5/2002 |

*Primary Examiner* — Gloria R Weeks

(74) *Attorney, Agent, or Firm* — McCarter & English, LLP

(57) ABSTRACT

The disclosure relates to relates to the use of trim sensors, registration sensors or pressure sensors to sense the position of a zipper during the manufacture of reclosable packages, particularly manufacturing processes wherein the ends of the zipper need to line up at the fin seal to insure success of the closure. The output of the sensors is used to adjust belt or roller speeds, or similar operational parameters to bring the zipper profiles into alignment at the fin seal.

17 Claims, 1 Drawing Sheet

(56) References Cited

U.S. PATENT DOCUMENTS

| | | | | |
|---|---|---|---|---|
| 7,172,545 | B2 * | 2/2007 | Howell et al. | 493/213 |
| 7,302,782 | B2 * | 12/2007 | Ausnit | 53/412 |
| 7,311,647 | B2 * | 12/2007 | Delisle et al. | 493/10 |
| 7,430,844 | B2 * | 10/2008 | Buchman et al. | 53/562 |
| 7,455,636 | B2 * | 11/2008 | Leighton | 493/213 |
| 7,513,858 | B2 * | 4/2009 | Howell et al. | 493/213 |
| 7,552,573 | B2 * | 6/2009 | Thieman | 53/412 |
| 8,122,687 | B2 * | 2/2012 | Kinigakis et al. | 53/412 |
| 8,353,147 | B2 * | 1/2013 | Sprehe et al. | 53/551 |
| 2002/0088202 | A1 * | 7/2002 | Van Rens et al. | 53/133.4 |
| 2006/0185325 | A1 * | 8/2006 | Buchman et al. | 53/412 |
| 2007/0084142 | A1 | 4/2007 | Matthews | |
| 2007/0271874 | A1 * | 11/2007 | Leighton | 53/412 |

* cited by examiner

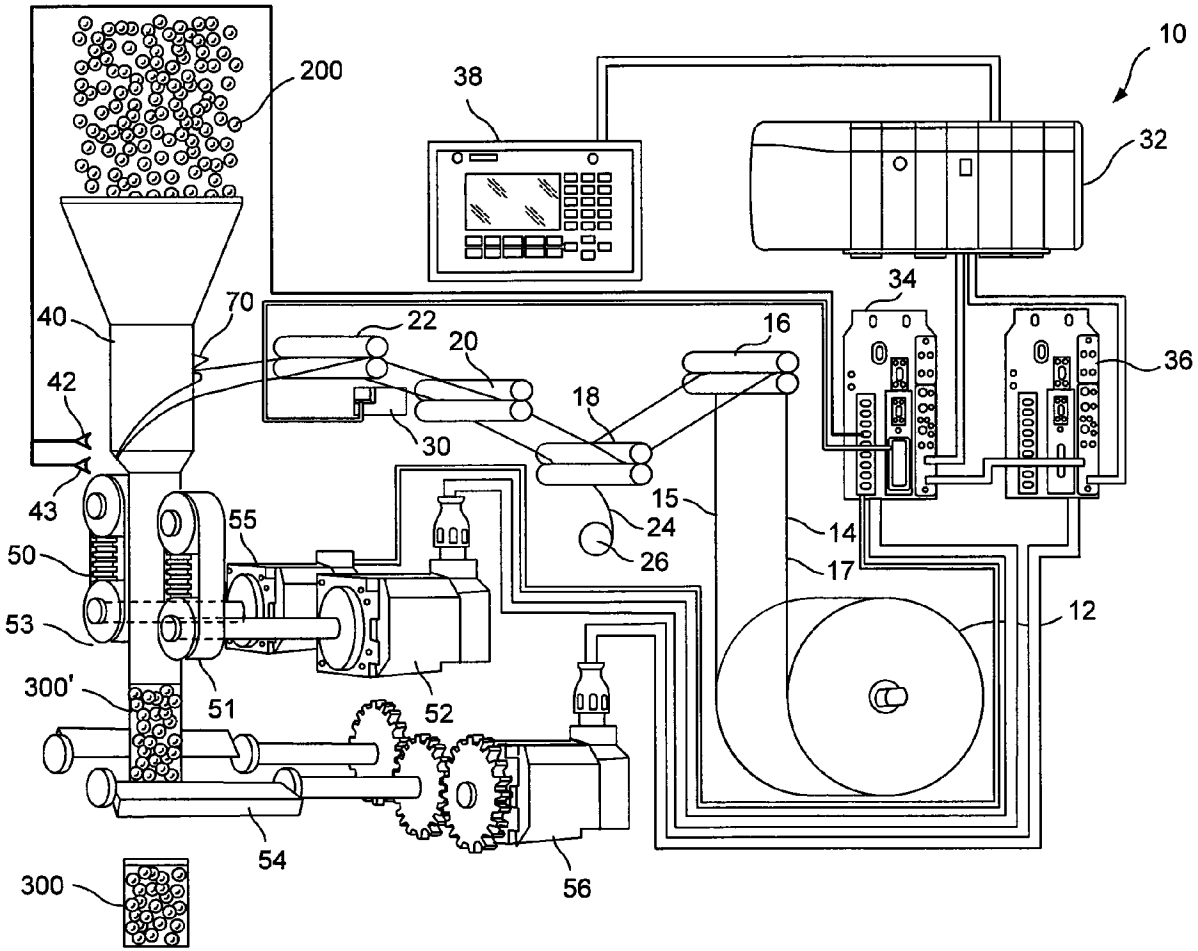
10
32
36
12
34
14
17
16
15
24
26
18
56
38
20
52
22
30
200
55
54
70
51
40
42
43
50
53
300'
300

FIN SEAL REGISTRATION IN MANUFACTURE OF RECLOSABLE PACKAGES

This application claims priority under 35 U.S.C. §119(e) of provisional patent application Ser. No. 61/329,361, filed on Apr. 29, 2010, the disclosure of which is hereby incorporated by reference in its entirety.

BACKGROUND OF THE DISCLOSURE

1. Field of the Disclosure

The present disclosure relates to the manufacture of reclosable packages or bags, particularly manufacturing processes wherein the ends of the zipper need to line up at the fin seal to insure success of the closure. This may be applied to wide mouth openings wherein a long unisex zipper is placed across the width of a film going through a machine, such as a vertical form fill seal machine, to make a pouch. The pouch could be of many styles, including a pillow, gusseted, or quad seal style.

2. Description of the Prior Art

High speed manufacture of reclosable packages is well-developed and very satisfactory for its intended purposes. However, further increases in manufacturing speed and decreases in manufacturing costs are always sought. In particular, some manufacturing processes for reclosable packages including, but not limited to, form fill and seal processes, could benefit from improvements to bring fine adjustment to the alignment of zipper profiles at the fin seal to further decrease any registration tolerances or errors, and further consistently increase the aesthetic appeal of the resulting package. Typical tolerances or errors are on the order of one eighth to one quarter of an inch, and may be as low as one sixteenth of an inch for ease of closure.

The possible misalignment of the zipper location at the fin seal can be induced by such factors as errors in the printing of the film registration marks; errors in the placement of the zipper on the film; errors created by the increased drag caused by the zipper at the fill tube and from the film distance travelled (drag) from the upstream sensor measuring the film registration marks; and errors created by the product flowing intermittently into the fill tube and hitting the pouch bottom creating a standing wave of varying tension around the fill tube.

SUMMARY AND OBJECTS OF THE DISCLOSURE

It is therefore an object of the present disclosure to improve the fine adjustment in the alignment of zipper profiles at a fin seal in manufacturing processes for reclosable packages. This is particularly adaptable to, but not limited to, form fill seal manufacturing processes.

This and other objects are attained by positioning a trim sensor (such as a vision system or similar apparatus or method) to sense the position of the zipper ends at the fin sealing location (such as the fill tube in a form fill seal apparatus). The output of the trim sensor is used to adjust belt or roller speeds, or similar operational parameters to bring the zipper profiles into alignment at the fin seal.

BRIEF DESCRIPTION OF THE DRAWINGS

Further objects and advantages of the disclosure will become apparent from the following description and from the accompanying drawing, wherein:

FIG. 1 is a perspective view of a vertical form fill seal machine implementing an embodiment of the present disclosure.

DETAILED DESCRIPTION OF THE PREFERRED EMBODIMENT

Referring now to the drawings in detail wherein like numerals indicate like elements throughout the several views, one sees that FIG. 1 is a perspective view of a vertical form fill seal machine 10 implementing an embodiment of the present disclosure.

The vertical form fill seal machine 10 includes a roll 12, from which a continuous sheet 14 of polymeric web or film is provided in a machine direction. Sheet 14 includes lateral edges 15, 17 oriented in the machine direction. Sheet 14 is typically guided by roller pairs such as those illustrated at 16, 18, 20, 22. A zipper strip 24 is provided from zipper strip roll 26 (or other source, such as a cartridge-type supply of successive zipper strips 24 in the form of zipper segments). Zipper strip 24 may be colored, dosed or otherwise treated or marked in order to aid in the accuracy of the sensing thereof. The zipper strip 24 is applied and sealed across the sheet 14 of web or film in transverse direction, typically in the proximity of roller pair 18. At least one sensor 30 is provided in the proximity of roller pair 22 for determining the presence and speed of sheet 14 of web or film. The output of sensor 30 is provided to control logic system 32 via first digital servo drive 34. Control logic system 32 includes an operator terminal 38 which typically includes a keyboard and a display screen. Control logic system 32 is in communication with first and second digital servo drives 34, 36.

Sheet 14 of web or film is wrapped around fill tube 40 so that lateral edges 15, 17 are brought together and sealed in a fin seal by a machine direction sealing bar (not shown). Trim sensors (or registration sensors) 42, 43 are located near the junction of lateral edges 15, 17 around the fill tube 40 and senses the position of the transversely-oriented zipper strip 24 with respect to the fin seal formed in the sheet 14 of web or film. The trim sensors 42, 43 are positioned so as to monitor both ends of the zipper strip 24 and thereby provide information regarding the alignment thereof. The trim sensors 42, 43 may be electric eyes or comprise a vision system. Further alternatives include proximity sensors which may include inductive proximity sensors, capacity proximity sensors, ultrasonic proximity sensors and photoelectric sensors (with capacitive or photoelectric sensors being typically used for a plastic target and inductive proximity sensors typically being used for a metal target). Additionally, as described hereinafter, pressure switch 70 may be substituted for trim sensors 42, 43. The output of trim sensors 42, 43, similar to the output of sensor 30, is supplied to control logic system 32 via first digital servo drive 34. Control logic system 32 uses the information from trim sensors 42, 43 to adjust the web speed, including the side-to-side web speed, as induced by drive roller assembly 50 which includes first drive belt 51 on a first side of fill tube 40 and second drive belt 53 on a second side of fill tube 40, opposite from the first side. First and second drive belts 51, 53 are driven by first and second drive roller servo motors 52, 55, respectively, which are, in turn, controlled by control logic system 32 via first digital servo drive 34 thereby controlling the placement and alignment of the ends of zipper strip 24 with respect to the fin seal. In this context, the term "drive roller servo motor" is being used to describe a mechanical device that delivers torque to rollers, belts, gear boxes and similar devices. Additionally, a KAM- BEROLLER® steering guide from Fife Corporation may be an acceptable alternative for this purpose.

First digital servo drive 34 is illustrated as controlling both first and second drive belts 51, 53, independently. This independent control is typically necessary in order to control the side-to-side web speed, and the alignment of zipper strip 24. In some applications, first digital servo drive 34 may be replaced with two digital servo drives.

The filled package 300 is formed by contents 200 being fed through fill tube 40 into the tube formed by sheet 14 with transverse sealing bar assembly 54 typically forming the upper seal of a lower completed package 300 and the lower seal of an upwardly adjacent package 300' (or, if the packages are manufactured in an inverted configuration, the lower seal of a lower completed package 300 and the upper seal of an upwardly adjacent package 300'). Transverse sealing bar assembly 54 is driven by low inertia brushless servo motor 56, which is controlled by control logic system 32 via second digital servo drive 36. The calculated desired speed of transverse sealing bar assembly 54 may likewise be influenced by the reading from the trim sensors 42, 43.

In this way, trim sensors 42, 43 (or registration sensors) are added to the vertical form fill and seal machine 10 to correct the film position in order to maintain the correct position (such as, but not limited to, a print position) relative to the end of the package 300 (such as, but not limited to, a pouch).

Further possible refinements to the disclosed embodiment include providing a sheet 14 of film with registration marks on either linear exterior and detecting these registration marks by registration sensors 42, 43 (typically electric eyes). The friction belts of drive roller assembly 50 which advance the sheet 14 of film are accelerated or decelerated as needed in order to line up the registration marks on either edge of the web or film as it descends the fill tube 40. This is turn, aligns the edges of the zipper strip 24 with respect to the fin seal. A further refinement includes adding pressure switches (illustrated on FIG. 1 as element 70, and typically having the same line of communication as illustrated for trim sensors 42, 43) located on the forming tube 40 which may detect either side of the zipper strip 24.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing reclosable packages or bags, including the steps of:

providing a sheet of web in a machine direction, the sheet including edges oriented in the machine direction;

providing a zipper to at least a substantial portion of a width of the sheet of web;

sensing a position of the zipper on the web;

controlling a speed of travel of the sheet of web in response to a position of the zipper sensed by the step of sensing;

forming reclosable packages or bags from the sheet of web;

wherein the step of forming reclosable packages or bags includes the steps of bringing the edges together and sealing the edges together in a fin seal;

wherein the step of forming reclosable packages or bags is performed downstream of the step of sensing a position of the zipper on the web; and wherein the step of controlling the speed of travel of the sheet of web is performed to align ends of the zipper at the fin seal.

2. The method of claim 1 wherein the fin seal is oriented in the machine direction.

3. The method of claim 2 wherein the step of bringing the edges together includes wrapping the sheet of web around a filling tube.

4. The method of claim 3 wherein the step of sensing a position of the zipper on the web is performed where the sheet of web is wrapped around the filling tube.

5. The method of claim 4 wherein the step of sensing is performed by a sensor is in communication with a control system.

6. The method of claim 5 wherein the step of providing a sheet of web in a machine direction includes the step of providing a web drive mechanism which drives the web at a speed as controlled by the control system.

7. The method of claim 6 wherein the step of providing the zipper includes the step of providing zipper segments.

8. The method of claim 7 wherein the zipper segments are provided in a direction transverse to the machine direction.

9. The method of claim 8 wherein the step of providing the zipper includes the step of sealing the zipper segments to the web.

10. The method of claim 9 wherein the sensor is at least one trim sensor.

11. The method of claim 9 wherein the sensor is at least one registration sensor.

12. The method of claim 9 wherein the sensor is at least one electric eye, vision system or proximity sensor.

13. The method of claim 9 wherein the sensor is at least one pressure switch.

14. The method of claim 9 further including the step of forming reclosable packages or bags includes the step of forming top and bottom seals in the web.

15. The method of claim 14 wherein the step of forming top and bottom seals in the web is performed after the step of forming a fin seal.

16. The method of claim 15 further including the step of filling the package or bag before a step of forming a first of the top and bottom seals and after a step of forming a second of the top and bottom seals.

17. The method of claim 16 wherein the method is a vertical form fill seal method.

* * * * *